US008544849B2

(12) United States Patent
Knell et al.

(10) Patent No.: US 8,544,849 B2
(45) Date of Patent: Oct. 1, 2013

(54) THREE-DIMENSIONAL JIGSAW PUZZLE

(75) Inventors: Florian Knell, Eberhardzell-Muehlhausen (DE); Joerg R. Bauer, Weingarten (DE)

(73) Assignee: Ravensburger-Spieleverlag GmbH, Ravensburg (DE)

( * ) Notice: Subject to any disclaimer, the term of this patent is extended or adjusted under 35 U.S.C. 154(b) by 181 days.

(21) Appl. No.: 13/124,432

(22) PCT Filed: Oct. 15, 2009

(86) PCT No.: PCT/EP2009/007403

§ 371 (c)(1),
(2), (4) Date: May 19, 2011

(87) PCT Pub. No.: WO2010/043395

PCT Pub. Date: Apr. 22, 2010

(65) Prior Publication Data

US 2011/0285083 A1 Nov. 24, 2011

(30) Foreign Application Priority Data

Oct. 15, 2008 (DE) ..... 10 2008 051 675

(51) Int. Cl.
*A63F 9/12* (2006.01)

(52) U.S. Cl.
USPC ..... 273/157 R

(58) Field of Classification Search
USPC ..... 273/157 R, 156
See application file for complete search history.

(56) References Cited

U.S. PATENT DOCUMENTS

| | | | | | |
|---|---|---|---|---|---|
| 1,409,082 | A | * | 3/1922 | Corbett | 273/157 R |
| 2,987,318 | A | * | 6/1961 | Hammer | 273/157 R |
| 3,578,331 | A | * | 5/1971 | DeGast | 273/157 R |
| 3,691,704 | A | * | 9/1972 | Novak | 52/81.4 |
| 3,865,382 | A | * | 2/1975 | Myller | 273/157 R |
| 4,824,112 | A | * | 4/1989 | Roy | 273/157 R |
| 5,104,125 | A | * | 4/1992 | Wilson | 273/157 R |
| 5,217,226 | A | * | 6/1993 | Christopher | 273/157 R |
| 5,236,196 | A | * | 8/1993 | Blankenburg et al. | 446/87 |
| 5,842,697 | A | * | 12/1998 | Scott et al. | 273/157 R |
| 6,073,929 | A | * | 6/2000 | Nahon | 273/156 |

(Continued)

FOREIGN PATENT DOCUMENTS

| | | | |
|---|---|---|---|
| DE | 60300658 T2 | | 10/2005 |
| EP | 887093 A1 | * | 12/1998 |

(Continued)

OTHER PUBLICATIONS

International Search Report for Appln. No. PCT/EP2009/007403 mailed Jan. 28, 2010.

(Continued)

*Primary Examiner* — Steven Wong
(74) *Attorney, Agent, or Firm* — Carter, DeLuca, Farrell & Schmidt LLP

(57) ABSTRACT

The invention relates to a three-dimensional, self-supporting jigsaw puzzle, having a multiplicity of puzzle pieces resulting in a hollow body in the assembled state, each puzzle piece having an upper face associated with the exterior of the hollow body, a lower face associated with the interior of the hollow body, an edge extending between the upper face and the lower face, and at least one connecting region extending from the edge in the form of a recess or an extension.

15 Claims, 4 Drawing Sheets

(56) References Cited

U.S. PATENT DOCUMENTS

| | | | | |
|---|---|---|---|---|
| 6,116,979 | A * | 9/2000 | Weber | 446/92 |
| 6,805,350 | B1 * | 10/2004 | Wu | 273/157 R |
| 7,490,831 | B2 * | 2/2009 | Simmons | 273/156 |
| 7,523,938 | B2 * | 4/2009 | Chuang | 273/157 R |
| 8,141,876 | B2 * | 3/2012 | Humphreys et al. | 273/156 |
| 2005/0179199 | A1 * | 8/2005 | Gaussen | 273/157 R |
| 2006/0145418 | A1 * | 7/2006 | Plein | 273/155 |
| 2009/0309302 | A1 * | 12/2009 | Langin-Hooper | 273/153 S |

FOREIGN PATENT DOCUMENTS

| | | | |
|---|---|---|---|
| EP | 1371401 | A1 | 12/2003 |
| EP | 1 524 014 | A1 | 4/2005 |
| WO | 03076032 | A1 | 9/2003 |

OTHER PUBLICATIONS

Chinese Office Action issued in corresponding application No. 200980141051.3 on Apr. 3, 2013.

* cited by examiner

THREE-DIMENSIONAL JIGSAW PUZZLE

TECHNICAL FIELD

The invention relates to a three-dimensional, self-supporting jigsaw puzzle, having a multiplicity of puzzle pieces resulting in a hollow body in the assembled state, each puzzle piece having an upper face associated with the exterior of the hollow body, a lower face associated with the interior of the hollow body, an edge extending between the upper face and the lower face, and at least one connecting region extending from the edge in the form of a recess or an extension. The term "self-supporting" here means that the hollow body resulting after assembly of the puzzle pieces has no separate supporting structure on which the puzzle pieces are to be fastened or on which they are supported. Rather, the hollow body is formed solely by the assembled puzzle pieces which result in a sufficiently stable bond in the assembled state.

BACKGROUND OF RELATED ART

A spherical self-supporting jigsaw puzzle of the type mentioned is known from EP 1 371 401 A1.

In the case of the above-mentioned, spherical jigsaw puzzle known from the prior art, the fit of the individual puzzle pieces with respect to one another is in need of improvement. In practice, therefore, the effort required to assemble the individual puzzle pieces varies, in particular towards the end of the jigsaw puzzle, when almost all the puzzle pieces have already been connected to one another, the assembly of the puzzle pieces requires too great a force. This non-uniform behaviour tends to lead to annoyance of the player and moreover gives the impression that the jigsaw puzzle is of low quality.

The object on which the invention is based is to remedy this and provide a three-dimensional self-supporting jigsaw puzzle, the puzzle pieces of which can be assembled without difficulties and give a player the feeling of an exact fit during assembly.

SUMMARY

Starting from a jigsaw puzzle of the generic type mentioned at the outset, this object is achieved according to the invention in that for every two adjoining puzzle pieces, the course of the mutually facing edges of the adjoining puzzle pieces between the upper face and the lower face is determined by the bisector of a dihedral angle formed between two straight lines which intersect on the bisector and which extend from an upper end point of the associated one of the mutually facing edges of the two adjoining puzzle pieces to an upper end point of an opposite edge of the same puzzle piece, or, in the case of a puzzle piece having a convexly curved upper face, to a first maximum in the direction of an opposite edge of the same puzzle piece, and in that in the connecting region the circumference of an edge of each extension is slightly smaller than the circumference of an edge of a recess in an adjoining puzzle piece corresponding to a respective extension. The expression "mutually facing edges" here means solely the edge portions of the puzzle pieces which are not associated with a connecting region. It is a characteristic of the present invention that a distinction is made between the edge regions which are associated with a connecting region and the remaining edge of a puzzle piece, since, owing to the fact that the circumference of each extension is deliberately kept smaller according to the invention (compared with the corresponding recess), one is free in the connecting regions to design the edge there differently from the remaining edge of a puzzle piece. The slightly smaller circumference of an extension is to be understood, in the context of the present invention, such that in the connecting region the edge of an extension does not touch the edge of a corresponding recess or—in the case of particular embodiments still to be described below—touches it only in a defined manner. By contrast, the edge of an extension was conventionally designed such that it fits exactly into the corresponding recess, i.e. generally bears more or less continuously against the opposite edge of the recess.

Particularly in the case of a spherical puzzle, it is advantageous also to modify the shape of the mutually facing edges which is obtained with the design specification explained above, in order to improve the puzzle assemblability further. Preferred embodiments of spherical puzzles therefore consist of puzzle pieces, the mutually facing edges of which do not run parallel to one another in the thickness direction of the puzzle pieces, but diverge from one another from the upper face to the lower face. In this way, the puzzle assemblability can be improved without adversely affecting the appearance, since at the visible exterior, i.e. the upper face, the mutually facing edges of the individual puzzle pieces can be joined together virtually without a gap, while between each two puzzle pieces an inwardly increasing gap results. Preferably, the deviation from the edge parallelism is overall at least five degrees, i.e. for each puzzle piece the edge course of the edge facing another puzzle piece deviates by at least 2.5 degrees in the described manner from a parallel course.

The jigsaw puzzle according to the invention is not restricted to the spherical shape, but may form in the assembled state a cube, a pyramid, a cuboid, a cylinder, a body with an elliptical cross-section, for example an egg-shaped body, or else combinations of the aforementioned bodies. Also possible are hollow bodies which cannot be assigned to any of the aforementioned geometrical base bodies, for example heart-shaped hollow bodies, animal-shaped hollow bodies and the like. The resulting hollow body does not need to be closed on all sides either, but can have at least one open side. Cup-, bowl- and vase-shaped hollow bodies may be mentioned here as examples. Finally, the resulting hollow body may constitute virtually any desired object, for instance a known building or the like.

The individual puzzle pieces may be plane or else curved or arched, also multiply curved. If the individual puzzle pieces are small compared with the curvature of the entire hollow body, a hollow body with curved or arched surfaces can also be assembled from plane puzzle pieces which form a good approximation of the arched shape owing to their comparative smallness. In such a case, only the extensions of the puzzle pieces need to be slightly angled.

Jigsaw puzzles according to the invention may comprise plane or arched puzzle pieces depending on the hollow body formed in the assembled state, and certain puzzle pieces may also include one or more body edges, for example the vertex of a pyramid or the corners and edges of a cube or cuboid. The puzzle pieces may be substantially of the same size, but they may also have different sizes. Each puzzle piece may have a plurality of connecting regions, it being possible for the connecting regions themselves to be designed identically or differently. The puzzle pieces may take the basic shape of the hollow body which results in the assembled state, i.e. substantially square puzzle pieces may form a cube, substantially hexagonal puzzle pieces may form a hexahedron, etc.

By the fact that, according to the invention, for adjoining puzzle pieces, the course of the mutually facing edges between the upper face and the lower face is determined by the bisector of a dihedral angle formed between two straight lines which intersect on the bisector and which extend from an upper end point of the associated one of the mutually facing edges to an upper end point of an opposite edge of the same puzzle piece, or, in the case of a convexly curved puzzle piece, to a first maximum in the direction of an opposite edge of the same puzzle piece, it is guaranteed for hollow bodies of virtually any shape that the respectively mutually facing edges of the puzzle pieces can bear exactly against one another. For convexly curved puzzle pieces, the design specification of the edge course according to the invention results in a press-fit connection which is firm and yet can be easily separated again. Because the edge of the puzzle piece main bodies, i.e. the puzzle pieces without the connecting regions, forms the vast majority of all the visible separating lines in the completed hollow body, exact fitting together of these edges leads to a significantly higher-quality appearance of the assembled hollow body.

Improved puzzle assemblability is ensured furthermore in that, according to the invention, the circumference of the edge of each extension is slightly smaller than the circumference of the edge of a recess in an adjoining puzzle piece corresponding to a respective extension. This feature ensures that the connecting regions of adjoining puzzle pieces can be inserted into one another both from above and from below in relation to one another, since the circumference of the edge of an extension is at most exactly the same size as the smallest circumference of the edge of a recess in the adjoining puzzle piece corresponding to this extension. By "at most exactly the same size" here is meant exactly the same size while observing customary dimensional tolerances, i.e. there is no contact in the connecting region between an extension and the recess corresponding to the latter. The gap existing between an extension and the corresponding recess is so small, however, that it is practically visually imperceptible and thus does not adversely affect in particular the outward appearance of the assembled hollow body. In other words, the edge geometry of each extension is designed such that each extension can be inserted into a corresponding recess both from above and from below. In the case of convexly curved puzzle pieces, e.g. in the case of an overall spherical puzzle, each extension is preferably formed such that its upper circumferential edge is smaller than the lower circumferential edge of the associated recess. Extensions and recesses of the puzzle pieces may be formed identically or, as is typical of jigsaw puzzles, noticeably differently from one another. The puzzle pieces may have an identical or different number of recesses or extensions. Puzzle pieces may also have extensions and recesses.

The edges of the extensions and of the recesses do have to meet the upper face and the lower face of the puzzle piece at right angles, when seen in cross-section, i.e. the edge course does not need to be perpendicular to the upper face and to the lower face, when seen over the cross-section, but may be inclined with respect to the upper and lower face. In this case, the edge of an extension and the corresponding edge of a recess can diverge from one another from the upper face to the lower face, in a similar manner to that already explained above in connection with the mutually facing edges of the puzzle pieces. It is, of course, also the case with such embodiments of the jigsaw puzzle according to the invention that each extension can be inserted into a corresponding recess both from above and from below.

For further improvement of the connecting quality and puzzle assemblability of the puzzle pieces with one another, in the case of preferred configurations of jigsaw puzzles according to the invention, in the connecting region at least one projection projecting from the edge of the recess or from the edge of the extension is in discontinuous contact with the opposite edge of the extension or of the recess, respectively. The expression "in discontinuous contact" here means that the projection projecting from the edge of the recess or of the extension is not in contact along the entire edge of the connecting region with the respectively opposite edge. In particular, the projection projecting according to the invention should not, therefore, be a rib extending along the entire connecting region. Preferably, the discontinuous contact is an approximately punctiform contact, i.e. the projecting projection is designed such that it makes only approximately punctiform contact with the opposite edge in the connecting region, although a short linear contact is likewise possible.

A plurality of projecting projections may be provided per connecting region. If the recess is an undercut recess, as is largely customary in the case of conventional jigsaw puzzles, then in the connecting region preferably one recess each is present on both sides of the beginning of the undercut, i.e. in the region in which the recess widens into the puzzle piece. By such an arrangement of projections, two adjoining puzzle pieces are drawn towards one another, which further improves the exact fit in the region of their edges lying outside the connecting region and increases the mutual support of the puzzle pieces among one another. The projections may extend from the edge of the recess or from the edge of the extension, but equally well one projection may extend from the edge of the recess and the second projection from the edge of the extension. More than two projections in the connecting region are also possible.

Preferably, the or each projection does not extend to the upper face and/or to the lower face of the extension or of the recess. In this way, the projections are not visible with the naked eye from the upper face and/or the lower face in the assembled state of the puzzle pieces.

Although not absolutely necessary, each projection is assigned a corresponding indentation in the opposite edge of the extension or of the recess, respectively. Without the corresponding indentation, each projection causes a preferably punctiform clamping between extension and recess in the connecting region. With a corresponding indentation, this clamping effect likewise occurs, but is complemented by a tangible latching or clicking of the parts into one another during assembly of the puzzle pieces, whereby the haptic quality of the puzzle assembly process is enhanced. A player thereby gets the feeling of puzzle pieces latching into one another exactly and with a defined effort.

The projections in the connecting region which are provided according to the invention in preferred embodiments allow a separation of the tasks of the different edge regions of a puzzle piece: the edge of the puzzle piece main body can be optimised for fitting accuracy and does not have to ensure clamping, while the connecting region can be optimised in the direction of simple assemblability from above downwards while simultaneously providing preferably punctiform clamping actions. The projections according to the invention may be provided merely in critical regions of the jigsaw puzzle or all over. In the latter case, all the projections as a whole preferably form a network of contact points extending over the outer surface of the hollow body, which additionally stabilises the assembled hollow body.

The edge between the upper face of the or each extension and the edge of the latter and/or the edge between the lower face of the or each extension and the edge of the latter may be of more or less rounded design. In this way, sharp edges are avoided and, in particular on the exterior of the hollow body, the typical appearance of a jigsaw puzzle is ensured. Analogously, the edge between the upper face of the or each recess and the edge of the latter and/or the edge between the lower face of the or each recess and the edge of the latter may be of more or less rounded design.

Finally, the edges between the upper face of each puzzle piece and the edge of the latter and/or the edges between the lower face of each puzzle piece and the edge of the latter may also be of more or less rounded design. It is also possible to combine non-rounded edges in particular on the upper face of the puzzle piece with rounded edges of the extensions and/or recesses. Such a configuration leads to a hollow body surface which is of very high quality because it is virtually closed, while still having the appearance typical of a jigsaw puzzle.

For all the embodiments of the jigsaw puzzle according to the invention which have been mentioned, the individual puzzle pieces can be advantageously produced from plastic by injection moulding.

BRIEF DESCRIPTION OF THE DRAWINGS

The invention is explained below in more detail with reference to the attached schematic figures, in which.

DETAILED DESCRIPTION

Figure 1:
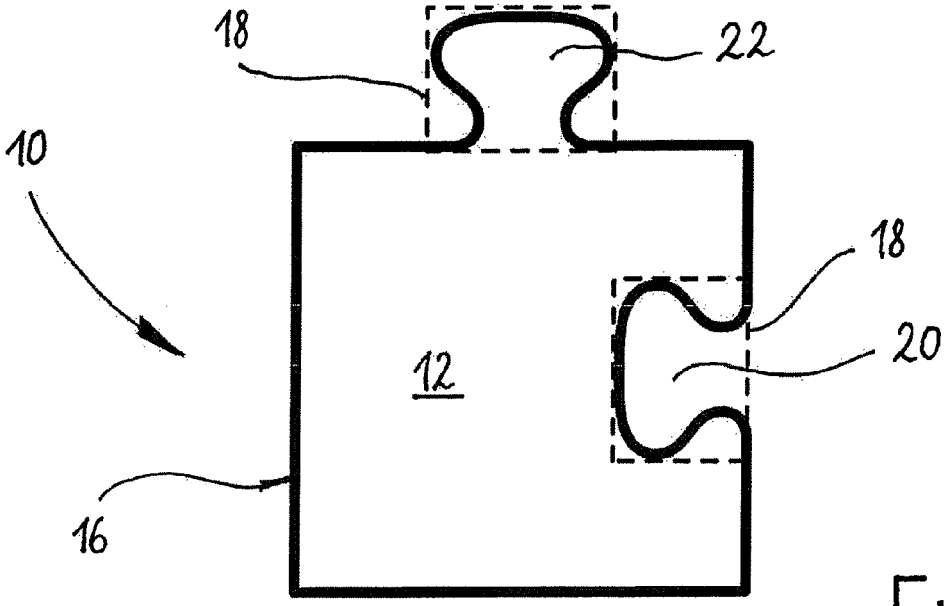
FIG. 1 shows a plan view of a puzzle piece having two connecting regions, one being formed as an extension and the other as a recess.
Figure 2:
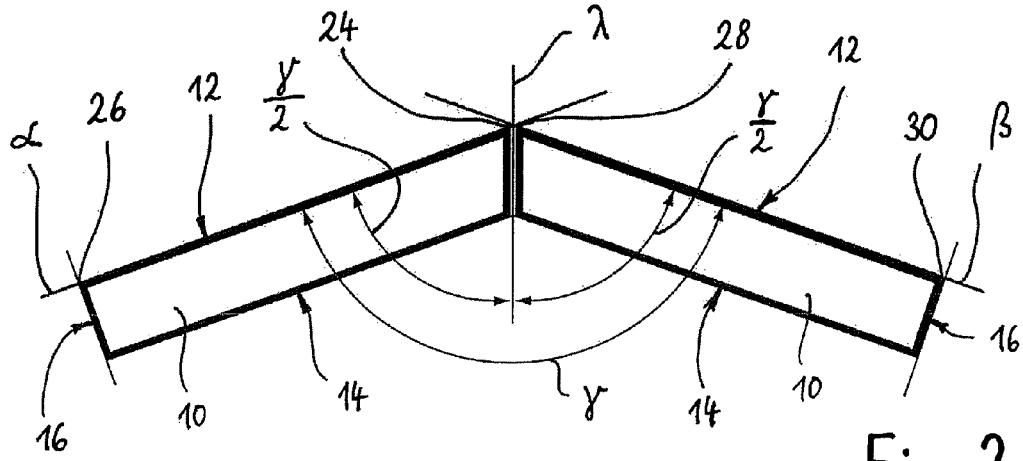
FIG. 2 shows a cross-section through two adjoining plane puzzle pieces.
Figure 3:
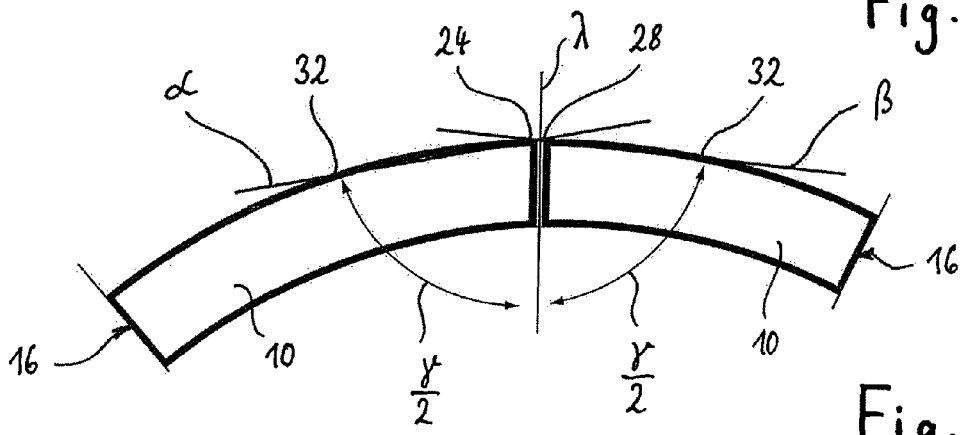
FIG. 3 shows a cross-section through two adjoining, curved puzzle pieces of different dimension.
Figure 4:
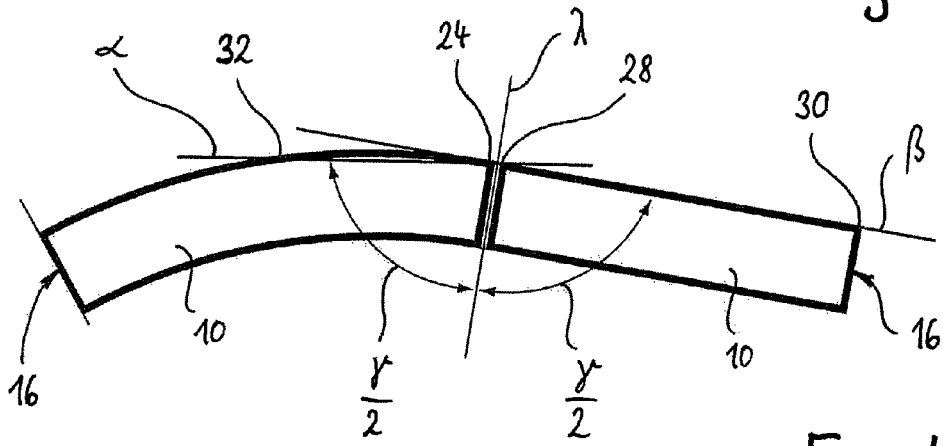
FIG. 4 shows a cross-section through two adjoining puzzle pieces, one of which is plane and the other curved.

FIG. 1 shows, by way of example, a puzzle piece 10 having an upper face 12 and a lower face 14, visible only in the sectional illustration of FIGS. 2 to 4. Extending between the upper face 12 and the lower face 14 is a circumferential edge 16 which is defined by the material thickness of the puzzle piece 10 and from which extend here two connecting regions 18, marked by broken lines.

One connecting region 18 has the form of a recess 20 extending into the puzzle piece 10, while the other connecting region 18 has the form of an extension 22 extending away from the puzzle piece 10.

The circumferential edge 16 of the puzzle piece 10 is not part of the connecting regions 18, only the edge portions which belong to a recess 20 or an extension 22 being assigned to the respective connecting region 18.

Both the recess 20 and the extension 22 are designed with in undercut in the example shown, although such an undercut design is not absolutely essential. To each recess 20 and each extension 22 there corresponds in an adjoining puzzle piece a correspondingly formed extension and a correspondingly formed recess, respectively, so that two adjoining puzzle pieces 10 can be connected to one another by fitting the connecting regions 18 into one another. It is understood that a plurality of recesses 20 and/or extensions 22 may be present on a puzzle piece 10 and that their shape may differ in each case.

A multiplicity of puzzle pieces 10, the appearance of which may of course differ from one another, results, in the assembled state, in a hollow body, such as, for example, a cube, a sphere, a pyramid, an octahedron, a cuboid, a heart, a bear or another animal or else a building. To ensure that such a hollow body is sufficiently stable in the assembled state and that the individual puzzle pieces 10 can be assembled simply and yet exactly, for every two adjoining puzzle pieces 10, the course of their mutually facing edges 16 between the upper face 12 and the lower face 14 is determined by a bisector $\lambda$ of a dihedral angle $\gamma$ formed between two straight lines $\alpha$ and $\beta$ (see FIGS. 2 to 4).

In FIG. 2, which shows a section through two adjacent puzzle pieces 10 of approximately equal size, the straight line a extends from an upper end point 24 of the edge 16, associated with the puzzle piece 10 on the left in FIG. 2, of the two mutually facing edges 16 to an upper end point 26 of an opposite edge 16 of the same puzzle piece 10 on the left in FIG. 2. Analogously, the straight line $\beta$ extends from an upper end point 28 on the puzzle piece 10 on the right in FIG. 2 to an upper end point 30 of the same puzzle piece. The two straight lines $\alpha$ and $\beta$ defined by the upper end points 24 and 26, and 28 and 30, form the dihedral angle $\gamma$ between them and intersect on the bisector $\lambda$ of this dihedral angle $\gamma$. The mutually facing edges 16 of the two puzzle pieces 10, between the upper face 12 and the lower face 14 of the associated puzzle piece 10, follow the bisector $\lambda$.

In FIG. 3, a section through two adjoining, curved puzzle pieces 10 of different size is shown. Here too, the course of the mutually facing edges 16 between the upper face 12 and the lower face 14 of the associated puzzle piece 10 is determined by two straight lines $\alpha$ and $\beta$ which, just as previously described, start from the upper end point 24 and 28, respectively, and extend, differently from FIG. 2, to a maximum 32 on the convexly curved upper face 12 in the direction of an opposite edge 16 of the same puzzle piece. The bisector $\lambda$, of the dihedral angle $\gamma$ formed between the two straight lines $\alpha$ and $\beta$ once again determines the course of the mutually facing edges 16 between the upper faces 12 and the lower faces 14 of the puzzle pieces 10. Since curved puzzle pieces 10 do not necessarily have to have a constant radius of curvature over their entire extent and may even be curved oppositely over their extent, it is advantageous to define the straight lines $\alpha$ and $\beta$ by the maximum 32, nearest to the mutually facing edges 16, on the upper face 12 of curved puzzle pieces 10.

FIG. 4 shows a section through two adjoining puzzle pieces, the left puzzle piece 10 of which is curved and the right puzzle piece 10 of which is plane. In the case of the curved puzzle piece 10, the straight line $\alpha$ is determined according to FIG. 3, and in the case of the plane puzzle piece 10, in contrast, the straight line $\beta$ is determined according to FIG. 2.

By means of the design specification stated above, the edges 16 of puzzle pieces 10 of virtually any desired shape can be defined such that a fit between the puzzle pieces which is exact and provides good mutual support of the puzzle pieces is always guaranteed. In some cases, for instance in the case of a spherical jigsaw puzzle, it is advantageous to modify the shape of the mutually facing edges 16 obtained with the design specification explained above such that these edges do not run parallel to one another in the thickness direction of the puzzle pieces 10, but diverge from one another from the upper face 12 of the puzzle piece to the lower face 14 of the puzzle piece. In this way, the mutually facing edges 16 of the individual puzzle pieces 10 can be joined together at their upper face 12 virtually without a gap, while an inwardly increasing gap results between each two puzzle pieces 10. Preferably, the deviation from the edge parallelism is overall at least five degrees, i.e. for each puzzle piece 10 the edge course of the edge facing another puzzle piece 10 deviates by at least 2.5 degrees in the described manner from a parallel course. It should be pointed out here that the edge 16 is only the edge of the main body of the puzzle piece, and that the design specifications given above therefore do not apply to the edge situated in the connecting regions 18.

Figure 5:
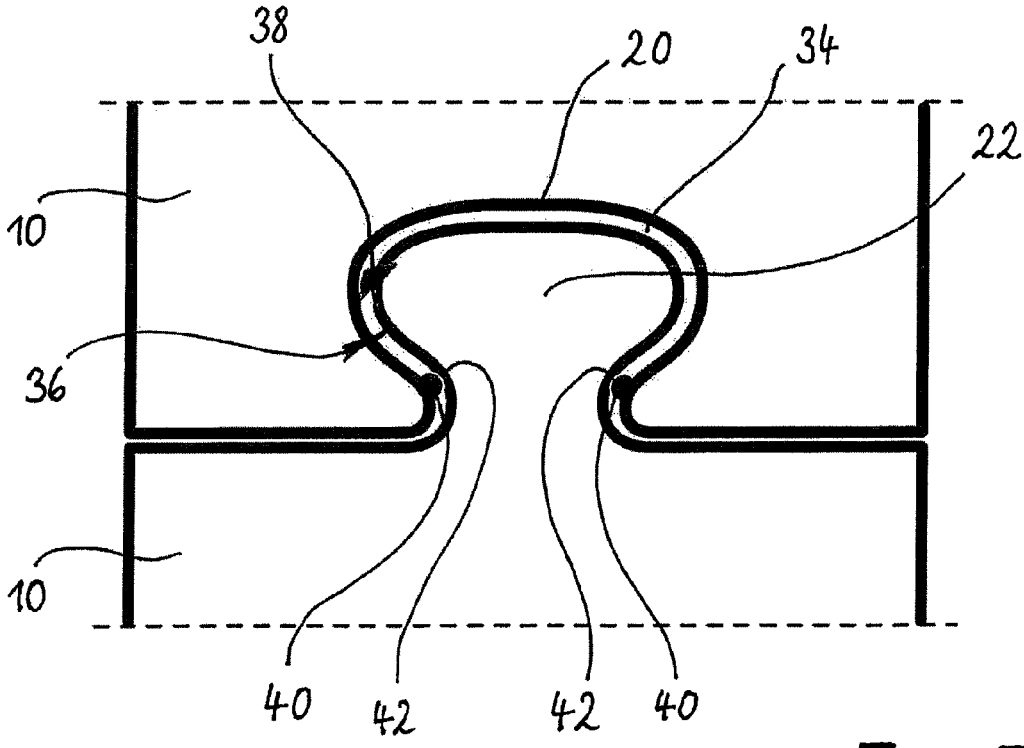
FIG. 5 shows in plan view an enlarged illustration of a connecting region of two adjoining puzzle pieces.

With reference to FIG. 5, which shows in plan view an enlarged illustration of two connecting regions 18, inserted into one another, of two adjoining puzzle pieces 10, the design specification for the edges of the connecting regions 18 will now be explained. As can be clearly seen in FIG. 5, a small gap 34 exists between the extension 22 and the corresponding recess 20, which gap results from the fact that in the connecting region 18 the circumference of an edge 36 of each extension 22 is slightly smaller than the circumference of an edge 38 of the recess 20 corresponding to the extension 22 in the adjoining puzzle piece 10. In FIG. 5, the size of the gap 34 is illustrated with an exaggerated size for reasons of clarity. In reality, the gap dimension will be chosen such that the gaps 34 are not disturbingly evident in the assembled hollow body and ideally are not visible to the naked eye.

For further improvement of the connecting quality between individual puzzle pieces 10 and to produce a high-quality feel of the puzzle, in the exemplary embodiment shown, there are provided, as can likewise be seen from FIG. 5, two projections 40 between two respectively corresponding connecting regions 18, which projections extend here from the edge 38 of the recess 20 and are in approximately punctiform contact with the opposite edge 36 of the extension 22. Each projection 40 is approximately hemispherical here and engages in a spherical-cap-shaped indentation 42 (see also the sectional illustration in FIG. 6). The two projections 40 are arranged opposite one another in the recess 20 at a location at which the undercut of the recess 20 begins. In this way, on insertion of the extension 22 into the recess 20, the puzzle piece 10 provided with the extension 22 is drawn towards the puzzle piece provided with the recess 20 and the mutually facing edges 16 of the two puzzle pieces 10 are laid against one another.

Figure 6:
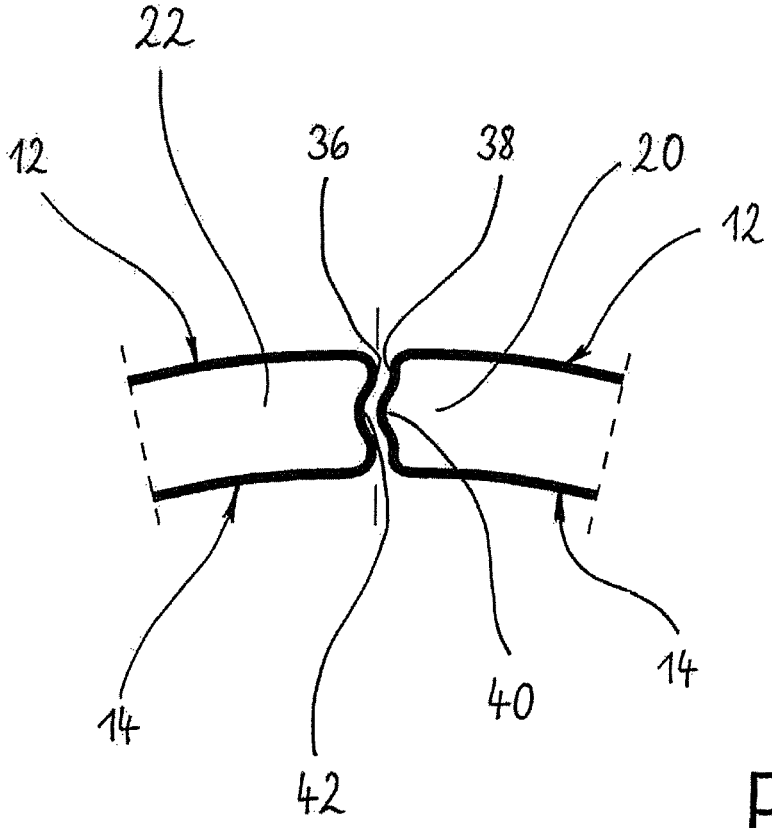
FIG. 6 shows the section VI-VI from FIG. 5.

As can be seen from FIG. 6 which has already been mentioned, when seen in the cross-sectional direction, each projection 40 is formed only in a central region of the edge 38, as is each indentation 42 in the edge 36. The approximately punctiform latching connection formed from projection 40 and associated indentation 42 is therefore practically not visible from the upper face 12 or the lower face 14 of the puzzle pieces 10. This also applies if, as shown in FIG. 6, the edges of the recess 20 and of the extension 22 are not of sharp-edged, but rounded design.

Figure 7:
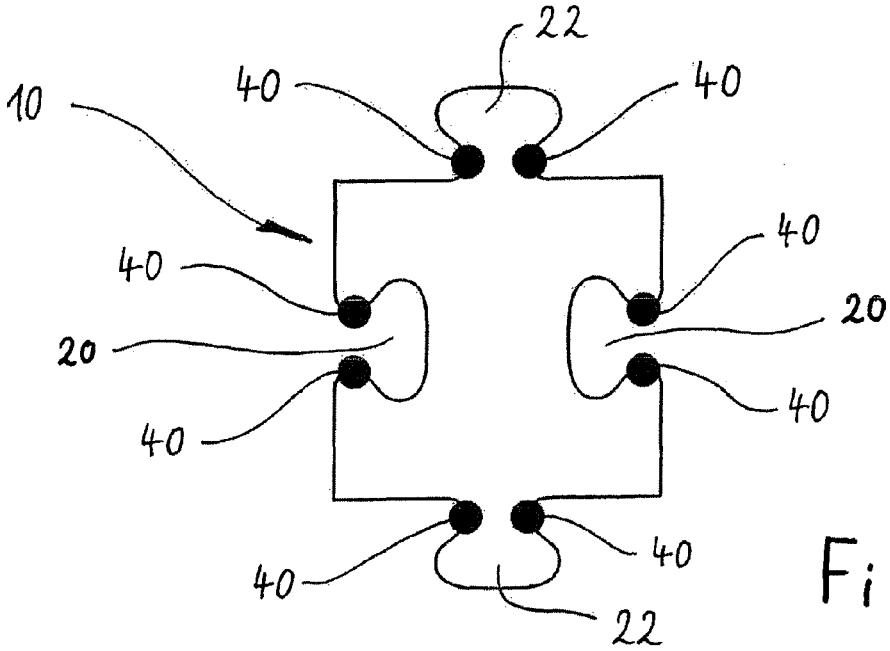
FIG. 7 shows in plan view a puzzle piece according to a preferred configuration.
Figure 8:
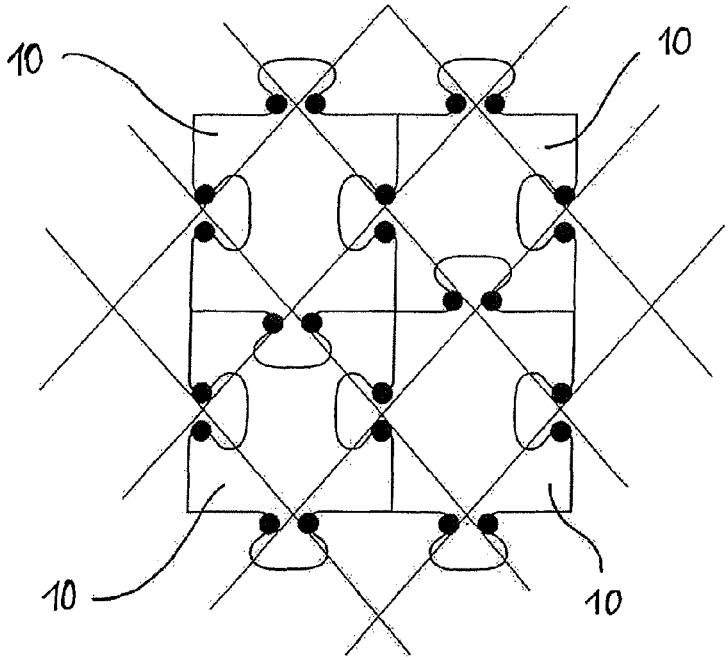
FIG. 8 shows four interconnected puzzle pieces according to FIG. 7 to illustrate a resulting network of contact points.

FIG. 7 shows a plan view of a puzzle piece 10 having two opposite recesses 20 and two likewise opposite extensions 22. In each recess 20 and on each extension 22, two opposite projections 40 each are formed at the beginning of the undercut. When puzzle pieces 10 of such design are assembled, there results, as illustrated in FIG. 8, a network of contact points between the individual puzzle pieces 10 which, in the assembled state of all the puzzle pieces, extends around the hollow body and ensures excellent stability together with very good puzzle assemblability, i.e. connectability of the puzzle pieces to one another.

The invention claimed is:

1. A three-dimensional, self-supporting jigsaw puzzle, comprising:

a multiplicity of puzzle pieces resulting in a hollow body in the assembled state, each puzzle piece having an upper face associated with the exterior of the hollow body, a lower face associated with the interior of the hollow body, an edge extending between the upper face and the lower face, and at least one connecting region extending from the edge in the form of a recess or an extension, wherein, for two or more adjoining puzzle pieces, at least one of which is a puzzle piece having a convexly curved upper face, the course of the mutually facing edges of the adjoining puzzle pieces between the upper face and the lower face is determined by the bisector of a dihedral angle formed between two straight lines which intersect on the bisector and which extend from an upper end point of the associated one of the mutually facing edges of the two or more adjoining puzzle pieces to an upper end point of an opposite edge of the same puzzle piece, or, in the case of a puzzle piece having a convexly curved upper face, to a first maximum in the direction of an opposite edge of the same puzzle piece, and in that in the connecting region the circumference of an edge of each extension is at most exactly the same size as the smallest circumference of an edge of a recess in an adjoining puzzle piece corresponding to a respective extension.

2. The jigsaw puzzle according to claim 1, wherein in the connecting region at least one projection projecting from the edge of the recess or from the edge of the extension is in discontinuous contact with the opposite edge of the extension or of the recess, respectively.

3. The jigsaw puzzle according to claim 2, wherein the discontinuous contact is an approximately punctiform contact.

4. The jigsaw puzzle according to claim 2, wherein each recess is an undercut recess and in that in the connecting region one projection each is present on both sides of the beginning of the undercut.

5. The jigsaw puzzle according to claim 2, wherein the or each projection does not extend to the upper face and/or to the lower face of the extension or of the recess.

6. The jigsaw puzzle according to claim 2, wherein each projection is assigned a corresponding indentation in the opposite edge of the extension or of the recess, respectively.

7. The jigsaw puzzle according to claim 2, wherein all the projections as a whole form a network of contact points extending over the exterior of the hollow body.

8. The jigsaw puzzle according to claim 1, wherein an edge between the upper face of the or each extension and an edge of the respective extension and/or an edge between the lower face of the or each extension and an edge of the respective extension is of rounded design.

9. The jigsaw puzzle according to claim 1, wherein an edge between the upper face of the or each recess and an edge of the respective recess and/or an edge between the lower face of the or each recess and an edge of the respective recess is of rounded design.

10. The jigsaw puzzle according to claim 1, wherein an edge between the upper face of each puzzle piece and the edge of the respective puzzle piece and/or an edge between the lower face of each puzzle piece and the edge of the respective puzzle piece is of rounded design.

11. The jigsaw puzzle according to claim 1, wherein mutually facing edges of the adjoining puzzle pieces diverge from one another from the upper face to the lower face.

12. The jigsaw puzzle according to claim 11, wherein a gap angle, which arises owing to the edges diverging from one another between adjoining puzzle pieces, is at least 5 degrees.

13. The jigsaw puzzle according to claim 12, wherein for each puzzle piece the edge course of the edge facing another puzzle piece deviates by at least 2.5 degrees from a parallel edge course.

14. The jigsaw puzzle according to claim 1, wherein the edge of each extension and the edge of a corresponding recess do not extend perpendicularly to the upper face and to the lower face, when seen in cross-section.

15. The jigsaw puzzle according to claim 14, wherein the edge of each extension and the edge of a corresponding recess diverge from one another from the upper face to the lower face, when seen in cross-section.

* * * * *